United States Patent [19]

Bender et al.

[11] 4,191,591

[45] Mar. 4, 1980

[54] METHOD AND APPARATUS FOR CLEANING A MATRIX OF A MAGNETIC SEPARATOR

[75] Inventors: Hans Bender, Leverkusen; Georg Schnabel, Hürth-Fischenich; Gottfried Düren, Cologne; Wolf Zabel, Seelscheid, all of Fed. Rep. of Germany

[73] Assignee: Klöckner-Humboldt-Deutz, Fed. Rep. of Germany

[21] Appl. No.: 971,644

[22] Filed: Dec. 20, 1978

Related U.S. Application Data

[63] Continuation of Ser. No. 848,645, Nov. 4, 1977, abandoned.

[30] Foreign Application Priority Data

Nov. 8, 1976 [DE] Fed. Rep. of Germany ..... 2650925

[51] Int. Cl.[2] ..... B08B 7/04; B03C 1/00

[52] U.S. Cl. ..... 134/25 R; 134/30; 134/36; 209/214; 209/222; 209/232; 210/222; 134/102

[58] Field of Search ..... 134/25 R, 30, 36, 21, 134/95, 102, 104; 209/214, 223 R, 232, 228, 222; 210/222, 223

[56] References Cited

U.S. PATENT DOCUMENTS

| | | | |
|---|---|---|---|
| 3,021,007 | 2/1962 | Jones | 209/223 R |
| 3,216,430 | 11/1965 | Besser | 134/102 |
| 3,326,374 | 6/1967 | Jones | 209/232 X |
| 4,046,680 | 9/1977 | Fritz | 209/214 |
| 4,052,310 | 10/1977 | Nolan | 210/222 |
| 4,087,358 | 5/1978 | Oder | 209/223 R |

*Primary Examiner*—Ralph J. Hill

*Attorney, Agent, or Firm*—Hill, Van Santen, Steadman, Chiara & Simpson

[57] ABSTRACT

A method and apparatus is disclosed for cleaning magnetic material attracted to a ferromagnetic matrix within a separating chamber of a magnetic separator. The magnetic material retained by the matrix is cleaned in a high pressure cleaning stage in which both a liquid medium and a gaseous medium are provided under pressure to clean the magnetic material. As the gaseous medium passes through the matrix, it does so with a pressure drop which is substantially lower than that of the liquid passing through the matrix. Consequently, as the gaseous medium expands, it transfers a portion of its kinetic energy to the liquid which provides improved and more rapid cleaning effects than known rinsing steps.

10 Claims, 2 Drawing Figures

METHOD AND APPARATUS FOR CLEANING A MATRIX OF A MAGNETIC SEPARATOR

This is a continuation of application Ser. No. 848,645, filed Nov. 4, 1977, now abandoned.

BACKGROUND OF THE INVENTION

The invention relates to a method for the cleaning of the matrix of a magnetic separator, whereby the matrix is cleaned with a liquid medium.

Furthermore, the invention relates to an apparatus for carrying out the method, and finally, a method for the operation of the apparatus.

Magnetic separators operating according to the hold-back principle are brought into use ordinarily for the handling of relatively large quantities of feed, for example in the range of 20 to 200 tons per hour. Additionally the separators are adapted in a special manner for the sorting of weakly magnetic minerals. The modus operandi os such hold-back wet magnetic separators in such that in a prescribed operating volume, the so-called separating chamber, a magnetic field as high as possible is produced, for example by means of the application of poles or in the inner chamber of a coil. Within this operating volume are located induction poles in the form of suitable magnetizable ferromagnetic bodies, which, on account of their high permeability, distort the magnetic field in such manner that strong inhomogeneities occur. Thus, the necessary gradients are produced at a plurality of preferred places in the volume of the separating chamber. The arrangement of the ferromagnetic body in a corresponding separating chamber is called the "matrix".

Upon the conveying through the matrix of a sludge laden with susceptible particles, the magnetic material contained in the sludge is held back on the ferromagnetic bodies on account of the high spatial magnetic forces. This held-back material is then ordinarily rinsed out of the matrix with a strong stream or jet of water.

This takes place with discontinuously or intermittently operating separators in such manner that the magnetic field is periodically disconnected and the magnetic material is rinsed out of the matrix in this disconnected condition. More and more, however, continuously operating separators are provided, as for example, the Jones Separator or the Carousel Separator.

In the case of such continuously operating separators, the magnetic material is moved out and washed out of the magnetic field with the matrix, after which the cleaned matrix is ready for the next passage through the magnetic field. According to the type of each magnetic material, it may also be necessary to clean the magnetic material from adherent non-magnetic material portions through a washing operation in the area of the magnetic field.

In addition, the necessity often arises of discharging intermediate products. This take place whereby within the magnetic field, a portion of the magnetic material is washed out with the adherent mine wastes with reduced rinsing energy.

As induction poles, there are employed in practice:

plates with projecting edges
profiled rods
loose balls or other loose spherical bodies
expanded metal—packets or briquettes
iron mesh—packings The last named filler bodies, namely, balls, expanded metal, and iron mesh, are adapted on account of their fine structure to the concentration of particularly weak magnetic substances and/or particles with especially fine granular structure. This is favorable because, in the case of the plurality of induction poles at small spacing, even the smallest particles even if occurring in small number, have the possibility of reaching and being retained in an area of higher magnetic force.

On the other hand, however, the washing out of these particles through the ordinary cleaning of the matrix with a strong jet of water is difficult, if not actually impossible, because the dense packing of balls, expanded metal and the like breaks the stream of the cleaning medium and permits the same to pass only with low speed and low energy through the spaces between the plurality of induction poles. In this manner, the cleaning of the matrix remains incomplete, because the jet energy of the non-compressible cleaning liquid decreases with the distance from the nozzle, and thereby enters into effect only in the edge zones of the induction poles, while in deeper areas it is broken through the filter-like packing of the induction poles and therefore becomes ineffective.

Also the attempt to compensate for this disadvantage through the utilization of large quantities of liquid, brought only a small result and which also has the disadvantage that:

(1) for the cleaning, a large path—time portion becomes necessary with corresponding diminution of the feed through yield of the separator, and (2) the large quantities of liquid make necessary more expensive clarification and separating apparatus, in order to separate the recovered solids from the cleaning liquid.

SUMMARY OF THE INVENTION

An object of the invention is to overcome the disadvantages of the known methods for washing out magnetic separating chambers in the case of hold back separators, and to thereby attain in economical fashion an improvement both qualitatively as well as quantitatively, of the modus operandi of such magnetic separators operating according to the hold-back principle.

This object is solved according to the invention in that, as an additional cleaning medium, a compressible medium is utilized.

The compressible medium, advantageously oil free compressed air, undergoes upon passage through the matrix, a substantially lower drop in pressure than the liquid, and upon its expansion transfers a portion of its kinetic energy to the liquid, which thereby intensively passes through the intermediate spaces of the induction poles. Therefore, a substantially better and also more rapid cleaning effect takes place than with the known rinsing step with exclusive application of liquid.

In an advantageous embodiment of the method, for example, the cleaning is carried out with a mixture of a liquid and gaseous medium.

In this connection, additional use may be made of the measure that the compressible medium is conveyed through under increased pressure through the matrix.

The method may also suitably be altered so that each of the two media comes into use in a timewise phase-changing manner.

For example, the charging of the compressible medium may take place some time after the supply of the liquid, and as the case may be, may still be continued after the liquid medium has already been shut off.

In this case, according to the invention, the procedure is such that the timewise changed phases overlap at least partially.

It may also be feasible to set up the cleaning operation so that the duration of the phases is different. For example, a short impact of compressed air towards the end of the liquid rinsing operation may attain the desired effect.

The compressed or pressure gas addition may, however, be longer or shorter than the liquid addition.

As the method is modified in detail according to the invention, in order to optimize the cleaning of the matrix of a hold back separator, according to the preparation requirements, each lies within the determination of the expert.

Furthermore, there results still another improvement of the method according to the invention wherein the compressible medium is added with pulsating pressure.

Also, the measure may be of advantage that during the cleaning, additional vibrations are introduced in the matrix.

An apparatus for carrying out the method according to the invention consists in the arrangement of a charging chamber connected in sealed fashion at least for the largest portion on the charging side of the matrix, which chamber has attachments for the introduction of the cleaning media.

In an advantageous embodiment of this apparatus, the charging chamber has a sliding member which produces the sealing connection between the stationary charging chamber and the movable matrix.

Furthermore, for the operation of the apparatus, a method may advantageously be provided which consists in that the charging chamber upon the rinsing operation brings with it the moving matrix and after conclusion of the rinsing operation is lifted from the matrix and brought back into the starting position.

In this connection, use may be made of the measure that the movements of the charging chamber and matrix may be automatically controlled in correspondence with the actuation of the control members for the rinsing media according to a functional program.

DESCRIPTION OF THE PREFERRED EMBODIMENTS

Figure 1:
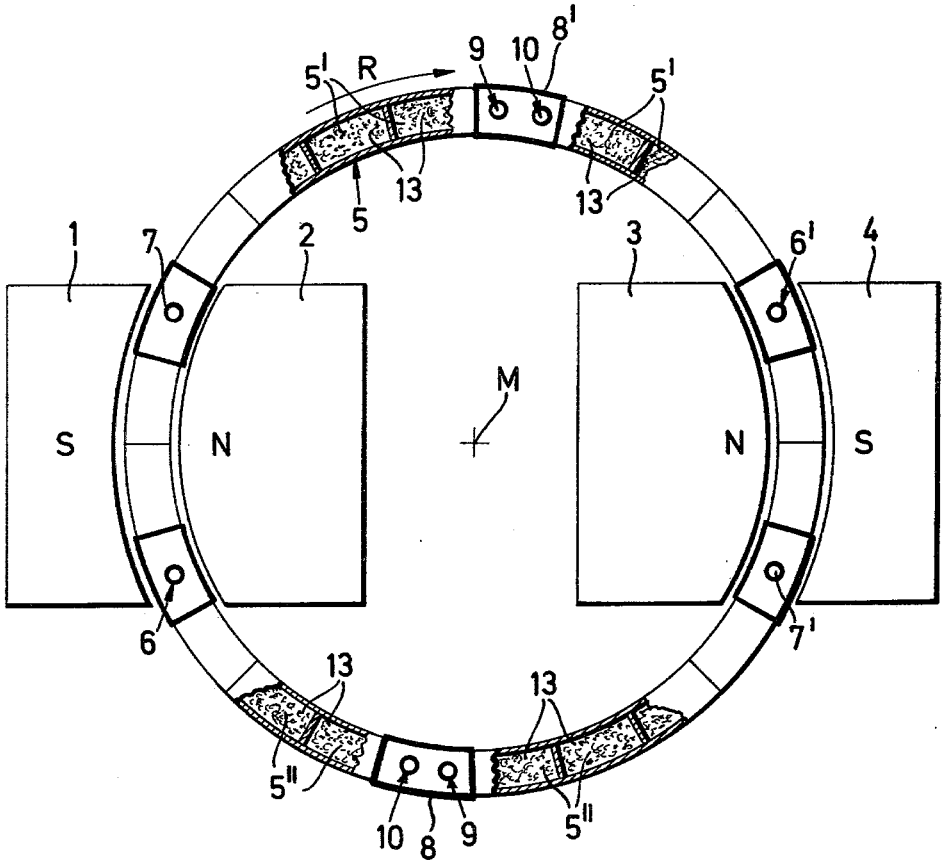
FIG. 1 shows a magnetic separator according to the invention in plan view.

The magnetic separator according to FIG. 1 possesses two pairs of magnetic poles with the four magnetic poles (1-2, 3-4) in "S-N", "N-S" arrangement.

Between the pairs of magnetic poles 1-2, 3-4 rotates a circular ring-shaped container arrangement 5 in direction of the arrow R. This container arrangement 5 is divided into cell-type separating chambers 5', 5". The latter are, as shown by way of example, filled out with packings of ferromagnetic bodies 13. One such individual cell 5', 5" filled with ferromagnetic bodies is called a "Matrix". For the ferromagnetic bodies forming the induction poles, grooved plates or spherical, ball-shaped or other loose filler bodies or, as also known, fillings made of expanded metal, iron mesh, etc. may be employed. Two charging stations are designated by 6 and 6' in which the material to be treated in the matrix 5', 5" traveling by is supplied with the liquid carrier medium in each case. The charging stations 6, 6' are located in each case in an inlet area of a magnetic field prevailing between one of the pairs of magnetic poles 1-2, 3-4. On the outlet area out of the magnetic field are provided in each case stations 7, 7' for a medium pressure rinsing, and outside of the magnetic fields are finally to be noted the rinsing stations 8, 8', in which the complete cleaning of the held-back magnetic material out of the separating chambers 5', 5" of the matrix takes place. The stations 8, 8' for the high-pressure rinsing each have a connection 9 for the liquid cleaning medium and an attachment 10 for the compressible medium.

Figure 2:
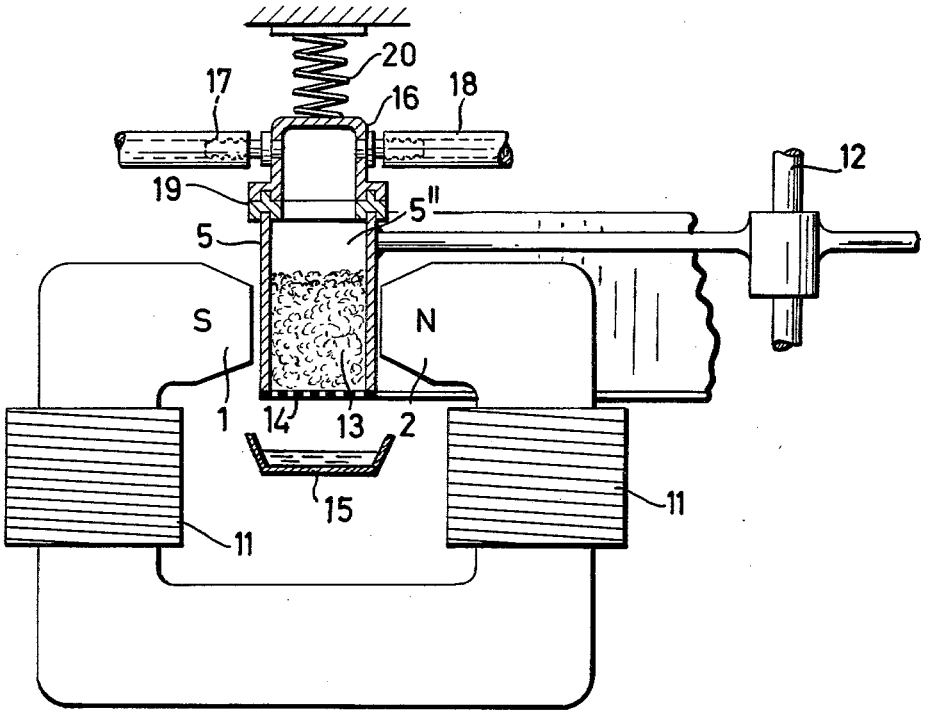
FIG. 2 shows another magnetic separator of the same category, as well as a matrix with mounted charging chamber, in section.

FIG. 2 shows a magnetic separator of the same type of functioning, in section.

There are illustrated the magnetic poles 1, 2, corresponding to the exciting windings 11. Between these magnetic poles 1, 2 the container arrangement 5 rotates about the axis of rotation 12. The filling of an individual matrix 5" can be seen with the ferromagnetic bodies 13. Towards the bottom, the matrix 5" is closed off by a porous bottom 14. Below the same is located the collection gutter 15, in which the rinsed material collects.

Above the matrix 5" is located the charging chamber 16, into which a connection 17 for the liquid cleaning medium and a connection 18 for the compressible medium empty. Between the matrix 5" and the charging chamber 16 is located as a sealing element the sliding member 19, which produces the sealing connection between the stationary charging chamber 16 and the movable separating chamber 5" of the matrix. The sliding member is pressed over the charging chamber 16 by means of a spring arrangement 20 elastically biased against the upper edge of the matrix 5".

The functioning of the arrangement is the following:

Between each two pairs of poles 1-2, 3-4 corresponding to "South-North, North-South", and which produce between them a strong magnetic field, continuously rotates the container arrangement 5. The latter is divided into individual cell-type separating chambers 5, 5", which have as magnetic induction poles a filling or packing of ferromagnetic body 13, called a matrix. Such ferromagnetic bodies 13, corresponding with the state of the art, may be, for example, gutter plates, loose balls or other loose bodies made of soft-magnetic iron, just as well as packings made of expanded metal, iron wool, etc. The container arrangement 5 rotates in the direction of the arrow R, driven with approximately constant speed by a driving arrangement, not shown in greater detail. Upon entry of a matrix 5" in one of the magnetic fields between the poles 1-2, 3-4, the latter reaches simultaneously the area of one of the two charging stations 6, 6' and, with the material to be separated comprising a suspension of magnetic and non-magnetic particles, is acted on in a carrier liquid. In this connection, the preponderant part of the non-magnetic material is rinsed-through as waste by or through the matrix, while the magnetically susceptible particles are retained as a magnetic material on the ferromagnetic bodies in the interior of the matrix. Shortly before the outlet from the magnetic field, the matrix passes station 7 or 7', respectively, for the average pressure rinsing. There, the magnetic concentrate is washed free of the adherent non-magnetic material and, each according to the energy of the cleaning operation, as the case may be, magnetic intermediate material is discharged as an intermediate product.

After complete rotating of a matrix 5, 5″ out of the area of one of the magnetic fields, the latter reaches one of the stations 8, 8″ for the high pressure rinsing.

There, by means of a liquid cleaning medium and according to the invention, additionally by means of a compressible cleaning medium under increased pressure, the magnetic material collected by the separator is rinsed out of the matrix. It is also preferable to permit the charging chamber 16 to move along with the matrix 5′, 5″ during the high pressure cleaning operation.

Out of the charging chamber lying in sealing fashion on the upper rim of the matrix, flows at the same time or consecutively, liquid and compressible cleaning medium under increased pressure through the packing of the ferromagnetic bodies and cleanses intermediate areas rapidly and thoroughly of adherent magnetic material.

The surprising effect of the invention rests on the fact that the compressible medium expands against the lower side 14 of the separating chamber of the matrix, and accordingly transfers for the most part the kinetic energy becoming free to the fluid cleaning medium located in the chambers between the ferromagnetic bodies. Here, the cleaning operation is intensified in an unusual manner and also in a shortened time, and—as tests have shown—an incomparably better cleaning operation occurs within a short time than was previously possible with exclusive utilization of liquid cleaning medium, particularly in the case of dense matrix structures.

Therefore, as already further mentioned above, it is an object for the average expert to determine the pressure relationships of both rinsing media as well as their time of introduction, in optimum fashion with respect to one another.

Thus, in some cases, it has already led to excellent results, if, at the end of the rinsing with a liquid rinsing medium, there was brought into use a short and if need be, pulsating impact pressure with the compressible medium, such as with the oil-free compressed air.

With these tests, it was also revealed that the addition of the compressed air with pulsating pressure produced an especially surprising and effective cleaning operation.

In other tests, in which vibrations were introduced during the rinsing operation in the matrix likewise brought surprisingly good results.

A special advantage of the method and apparatus according to the invention is that it can be applied as an additional subsequent improvement in the case of a magnetic separator of a corresponding type. It is possible with older magnetic-separator installations, by means of qualitative and quantitative increases of the operating results, to attain improved operation with relatively slight costs.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A method for cleaning of magnetic material retained by a ferromagnetic matrix of a magnetic separator comprising the steps of cleaning the matrix to wash free the magnetic material in a high pressure rinse, said cleaning including the steps of first introducing a liquid medium into a cleaning chamber and then separately introducing at a later time a compressed gaseous medium under high pressure and without prior mixing with the liquid medium directly into the cleaning chamber lying in sealed relationship directly above the matrix such that the liquid passing downwardly through the matrix receives additional kinetic energy as a result of the introduction of the high pressure gaseous medium.

2. A method according to claim 1, including the further step of at least partially overlapping the addition of the liquid medium and gaseous medium.

3. A method according to claim 1, including the step of adding the media with time durations which differ from each other.

4. A method according to claim 1, comprising the step of adding the compressible gaseous medium and liquid medium in cyclical fashion.

5. A method according to claim 1, including the step of introducing vibrations in the matrix by introduction of the liquid and gaseous media during the cleaning.

6. An apparatus for separating magnetic material, comprising:

a separating chamber having a ferromagnetic matrix associated therewith for attracting magnetic material;

a charging chamber connected in gas sealing fashion directly to a charging side of the separating chamber and matrix;

means connected directly to the charging chamber for the separate introduction of a liquid medium and the separate introduction of a compressed gaseous medium directly into the charging chamber without prior mixing.

7. An apparatus according to claim 6, characterized in that the charging chamber is stationary and has a sliding member means for a slidable gas sealing connection between the stationary charging chamber and the matrix of the separating chamber, said separating chamber being rotatable.

8. The apparatus of claim 6 wherein the charging chamber has directly connected thereto a first hose connected to the gaseous medium and a separate second hose connected to the liquid medium.

9. A method for cyclically cleaning magnetic material retained by a ferromagnetic matrix during rotation of a rotatable magnetic separator comprising the steps of:

providing a charging chamber for sealed attachment to the rotating separation chamber containing the matrix; and separately introducing a liquid cleaning medium for cleaning into a top of the charging chamber and separately introducing a gaseous medium into the top of the charging chamber when the liquid medium is present.

10. A method according to claim 9, comprising the step of automatically controlling movements of the charging chamber and matrix in correspondence with the actuation of control members for the cleaning medium according to a functioning program.

* * * * *